US006337609B1

(12) United States Patent
Endou et al.

(10) Patent No.: US 6,337,609 B1
(45) Date of Patent: Jan. 8, 2002

(54) DELAY COMPENSATION DEVICE, DELAY LINE COMPONENT AND MANUFACTURING METHOD OF THE DELAY LINE COMPONENT

(75) Inventors: Kenji Endou; Yoshiyuki Yasukawa; Tadao Fujii, all of Chiba (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/381,298

(22) PCT Filed: Jul. 14, 1997

(86) PCT No.: PCT/JP98/03149

§ 371 Date: Sep. 22, 1999

§ 102(e) Date: Sep. 22, 1999

(87) PCT Pub. No.: WO99/04450

PCT Pub. Date: Jan. 28, 1999

(30) Foreign Application Priority Data

Jul. 17, 1997 (JP) ..... 9-207398
Jul. 25, 1997 (JP) ..... 9-213909

(51) Int. Cl.[7] ..... H01P 9/00; H01P 1/18
(52) U.S. Cl. ..... 333/160; 333/156
(58) Field of Search ..... 333/160, 156

(56) References Cited

U.S. PATENT DOCUMENTS 4,574,438 A * 3/1986 Diepers et al. ..... 29/25.42
6,107,989 A * 8/2000 Rauscher ..... 333/175

FOREIGN PATENT DOCUMENTS

| | | |
|---|---|---|
| JP | 32-4383 | 6/1957 |
| JP | 52-96845 | 8/1977 |
| JP | 54-42960 | 4/1979 |
| JP | 54-88049 | 7/1979 |
| JP | 56-28513 | 3/1981 |
| JP | 1-172704 | 12/1989 |
| JP | 3-125504 | 5/1991 |
| JP | 4-180212 | 6/1992 |
| JP | 5-315757 | 11/1993 |
| JP | 5-327221 | 12/1993 |
| JP | 5-335820 | 12/1993 |
| JP | 6-61716 | 3/1994 |
| JP | 6-224650 | 8/1994 |

* cited by examiner

*Primary Examiner*—Benny Lee
*Assistant Examiner*—Kimberly E Glenn
(74) *Attorney, Agent, or Firm*—Arent Fox Kintner Plotkin & Kahn, PLLC

(57) ABSTRACT

A delay line component having merits of small physical size and small insertion loss in a radio frequency. The delay line component with coaxial cable structure includes a center conductor, a dielectric which surrounds the center conductor and an outer conductor which is formed outside the dielectric. The dielectric is made of a ceramic dielectric with a large dielectric constant.

32 Claims, 10 Drawing Sheets

DELAY COMPENSATION DEVICE, DELAY LINE COMPONENT AND MANUFACTURING METHOD OF THE DELAY LINE COMPONENT

TECHNICAL FIELD

The present invention relates to a delay compensation device and a delay line component for a radio frequency low distortion power amplifier used in a radio base station of portable phone communication systems and to a manufacturing method of the delay line component.

BACKGROUND ART

In a radio base station of potable phone communication system, the final stage of a radio frequency power amplifier is required to simultaneously amplify a number of different radio frequency signals which are amplitude modulated or frequency modulated for communication. In such a high power radio frequency amplifier used in the radio base station, the signals are usually affected by non-linear operation characteristics of used active components like transistors. Once the signals are affected by such non-linear characteristics, third harmonic inter modulation distortion (hereinafter called as "IMD ") is caused and unnecessary radiation interference is resulted. To suppress such interference, some linearisation processing is necessary in radio frequency power amplification. To prevent IMD, an amplifier by feed-forward method (hereinafter called as "FF") is used as shown in FIG. 1 (Japanese Unexamined Patent Publication No.6-224650).

In the figure, the reference number 10 is an input terminal of radio frequency signals for amplification, 11 is the first directional coupler connected with the input terminal 10, 12 is a main amplifier connected with the coupling port of the first directional coupler 11, 13 is a first delay compensation device connected with the primary output port of the first directional coupler 11, 14 is a second directional coupler connected with the output of the main amplifier 12, 15 is a third directional coupler connected with the output of the first delay compensation device 13 and with the coupling port of the second directional coupler 14, 16 is an error amplifier connected with the primary output port of the third directional coupler 15, 17 is a second delay compensation device connected with the primary output port of the third directional coupler 14, 18 is a fourth directional coupler connected with the output of second delay compensation device 17 and with the output of the error amplifier 16, and 19 is an output terminal of amplified radio frequency signals connected with the primary output port of the directional coupler 18.

As will be apparent from FIG. 1, an input radio frequency signal via the input terminal 10 is divided into two signals by the first directional coupler 11, and one of the divided signal is amplified by the main amplifier 12 which generates IMD components (distortion signals) resulted from its non-linearity characteristics in addition to the main signals. The other of the divided signal propagates the first delay compensation device 13 which has a similar delay characteristic as the main amplifier 12. By the directional coupler 15, the output of the delay compensation device 13 is inversely added with the signal, which is adjusted by signal level and phase controllers not shown in the FIG. 1, from the coupling port of the directional coupler 14. As a result, the two main signal components are canceled each other, and only IMD component (distortion signals) is left. The IMD component is amplified at the error amplifier 16 up to the level that is needed to cancel the IMD component generated in the main amplifier 12.

The output signal of the main amplifier 12 propagates the second delay compensation device 17 which has a similar delay characteristic as the error amplifier 16. And the output signal of the second delay line device 17 is inversely added with the IMD component from the error amplifier 16 by the fourth directional coupler 18. Consequently, the two components of IMD are canceled each other and only the amplified radio frequency signal via the input terminal 10 is output via the output terminal 19. By this configuration, a radio frequency amplifier system with good distortion characteristics can be built.

However, this kind of FF type amplifier has problems shown below.

(1) The typical requirement of delay time of the delay compensation device for such amplifier is tens of nanoseconds. If a coaxial cable type of delay line is used for the delay compensation device, the delay time of tens of nanoseconds requires a few meters length of the coaxial cable. That results in very large physical size. And definite propagation loss is resulted when small diameter coaxial cable is applied for physical size reduction.

(2) If a filter by combined resonators is applied for the delay compensation device, more than 10 stages of the resonators are required to achieve tens of nanoseconds. This results in large propagation loss, increased work load of assembling and difficulty in parameter adjusting.

(3) If a micro strip line structure is used as shown in Japanese Unexamined Patent Publication No.2-24120, the propagation loss becomes very large because of electromagnetic energy concentration at the side edges of strip line conductor.

(4) In an actual power amplifier system, the main amplifier and the error amplifier have independent and different frequency transfer characteristics. And in order to completely remove IMD components, the frequency transfer characteristics of the two different amplifiers must be adjusted to be matched each other in a certain frequency range. This requires very complicated and careful tests and adjustments of the main amplifier and the error amplifier after the build of the power amplifier system. The work load of manufacturing is remarkably increased.

DISCLOSURE OF INVENTION

It is therefore an object of the present invention to solve the problems in the conventional art, and to provide a delay compensation device, a delay line component and manufacturing method of the delay line component that can contribute to realize small propagation loss in a radio frequency and a very small physical bodied device.

Another object of the invention Is to provide a delay compensation device, whereby two frequency transfer characteristics of a main amplifier and an error amplifier can be easily adjusted and matched each other.

The present invention provides a delay line component with coaxial cable structure, including a center conductor, a dielectric which surrounds the center conductor and an outer conductor which is formed outside the dielectric. The dielectric is made of a ceramic dielectric with a large dielectric constant.

In order to get for example 35 nanoseconds of delay time, 10.5 meters length of a line in vacuum environment is needed. An usually widely used coaxial cable uses dielectric insulator with the dielectric constant of $\in r=2–3$, and around 7 meters of such cable is necessary for 35 nanoseconds delay. In the present invention, a large dielectric constant ceramic insulator is used for the coaxial cable dielectric material, and consequently the cable length can be greatly reduced. If the used ceramic insulator's dielectric constant is $\in r=92$, the propagation velocity factor expressed by root square of $\in r$ becomes about 9.6. The necessary length by such coaxial cable for 35 nanoseconds delay is only about 1.1 meters.

It is preferred that the ceramic dielectric in the coaxial cable structure is made of sintered ceramic materials or a dielectric with a resin in which ceramic particles are included.

It is preferred that at least the center conductor is made of a metal conductor with no grain boundary It is also preferred that the center conductor is formed by a metal conductor melted and sintered in a center hole of the ceramic dielectric, by a pipe-shaped metal conductor inserted and rolled in a center hole of the ceramic dielectric, or by a wire-shaped solid metal conductor inserted into a center hole of the ceramic dielectric.

If the center conductor is formed by a pipe-shaped metal conductor rolled in the center hole of the ceramic dielectric, preferably, this center conductor is formed by a metal conductor which is expanded by static inside pressure or by explosive gaseous pressure and closely contacted to an inner surface of the center hole.

It is very preferred that the ceramic dielectric is formed by a plurality of independent ceramic dielectric blocks with a predetermined axis length. The electromagnetic mode in a coaxial cable is basically TEM (Transverse Electro-Magnetic Mode), and there is no electric and magnetic field component toward the direction of propagation. The ceramic dielectric is not necessary to be consecutive along the direction of wave propagation in a coaxial cable. This permits to link or stack a plurality of short and proper length ceramic dielectric blocks along the direction of coaxial cable.

Each of the ceramic dielectric blocks may be formed by a cylindrical shaped or polygonal tube shaped block with a center hole.

It is preferred that the outer conductor is formed by a metal film sintered on an outer surface of the ceramic dielectric, or by a pipe-shaped metal conductor which covers in contact the outer surface of the ceramic dielectric.

It is also preferred that the ceramic dielectric located in at least one end portion of the delay line component has a dielectric constant which is different from that of the ceramic dielectric located in another portion of the delay line component.

It is also preferred that the ceramic dielectric located in at least one end portion of the delay line component has a ratio of inner/outer diameters which is different from that of the ceramic dielectric located in another portion of the delay line component.

It is also preferred that the ceramic dielectric located in at least one end portion of the delay line component has an outer diameter which is different from that of the ceramic dielectric located in another portion of the delay line component.

It is preferred that a main delay line portion of the delay line component consists of only a straight coaxial cable line, or includes a plurality of straight coaxial cable lines, and a plurality of curved coaxial cable lines which connect the straight coaxial cable lines with each other.

In the latter case, the dielectric of the curved coaxial cable lines is made of a dielectric with ceramic particles mixed in a soft resin, or made of a plurality of independent ceramic dielectric blocks.

Also, the present invention provides a delay compensation device having a coaxial cable type delay line component with a center conductor, a dielectric which surrounds the center conductor and an outer conductor which is formed outside the dielectric, and a band pass filter connected with at least one end portion of the delay line component.

Since at least one end portion of the delay line component is equipped with the band pass filter, the frequency transfer characteristics of each amplifier can be adjusted to be matched each other.

It is very preferred that the band pass filter is designed so that its frequency transfer characteristics is adjustable.

It is also preferred that an input characteristic impedance and an output characteristic impedance are different with each other in the band pass filter. Thus, impedance matching between the delay line component and external circuit connected thereto can be possible.

It is preferred that a band pass filter is connected with only one end portion of the delay line component, or that band pass filters are connected with the both end portions of the delay line component, respectively.

Furthermore, the present invention provides a method of manufacturing a coaxial cable type delay line component which includes a center conductor, a dielectric which surrounds the center conductor, and an outer conductor which is formed outside the dielectric. The method includes a step of forming the dielectric by linking a plurality of linked independent ceramic dielectric blocks with a predetermined axis length by glass paste and by sintering them to make a long integral member.

It is preferred that the dielectric is made of a sintered ceramic dielectric with a large dielectric constant.

Also, the present invention provides a method of manufacturing a coaxial cable type delay line component which includes a center conductor, a dielectric which surrounds the center conductor, and an outer conductor which is formed outside the dielectric. The method includes a step of forming the dielectric by mixing ceramic particles in a resin.

It is preferred that at least the center conductor is made of a metal conductor with no grain boundary.

It is preferred that the center conductor is formed by filling metal material into a center hole of the ceramic dielectric, and by melting and sintering the filled metal material, formed by inserting a pipe-shaped metal conductor into a center hole of the ceramic dielectric, and by expanding the pipe-shaped metal conductor by static inside pressure or explosive gaseous pressure to closely contact to an inside surface of the center hole, or formed by inserting a wire-shaped solid metal conductor into a center hole of the ceramic dielectric.

It is also preferred that the outer conductor is formed by covering an outer surface of the ceramic dielectric with a metal paste and by sintering the metal paste, or formed by covering an outer surface of the ceramic dielectric with a pipe-shaped metal conductor.

BEST MODE FOR CARRYING OUT THE INVENTION

Figure 1:
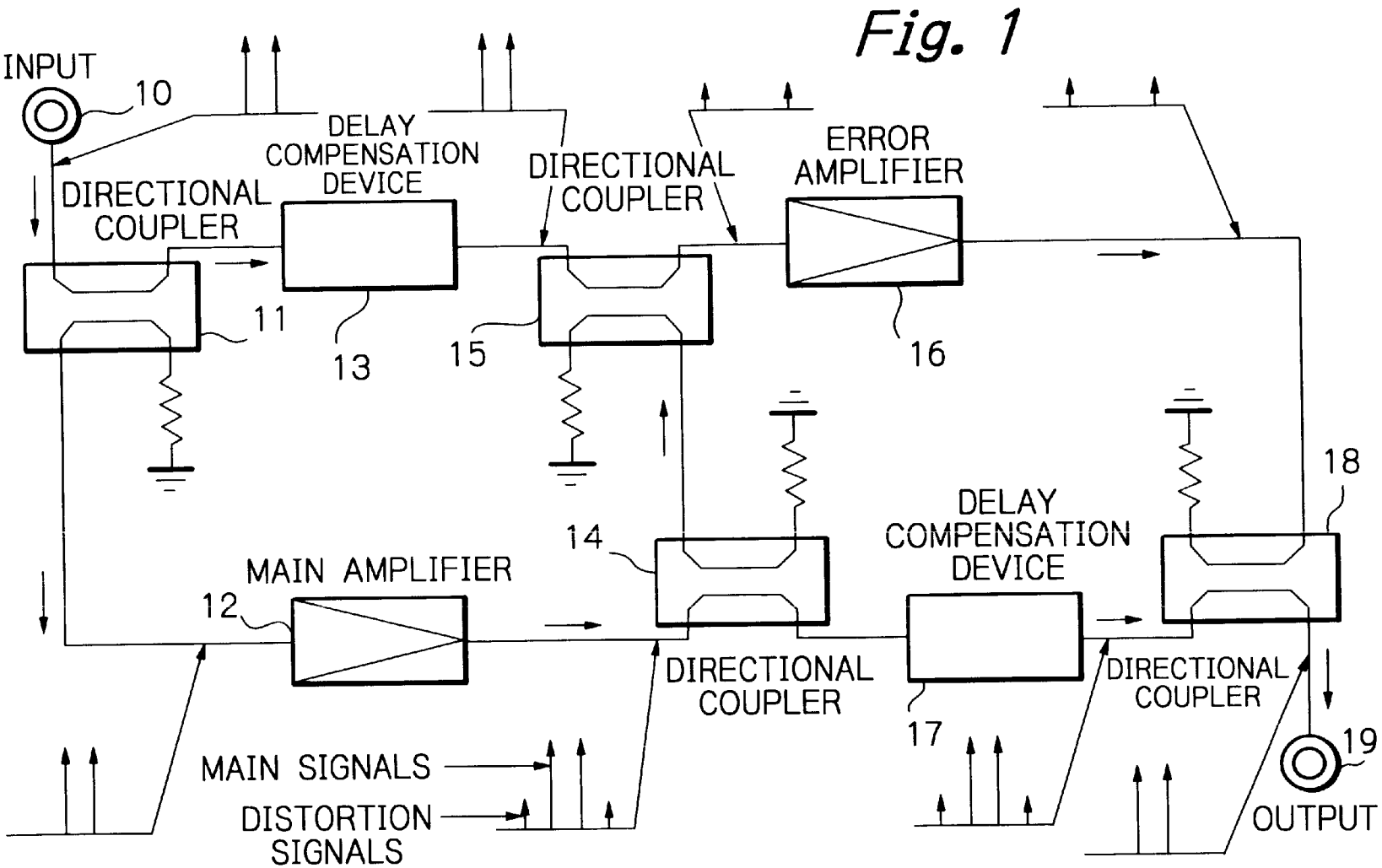
FIG. 1 is a block diagram schematically illustrating constitution of a FF type power amplifier.
Figure 2:
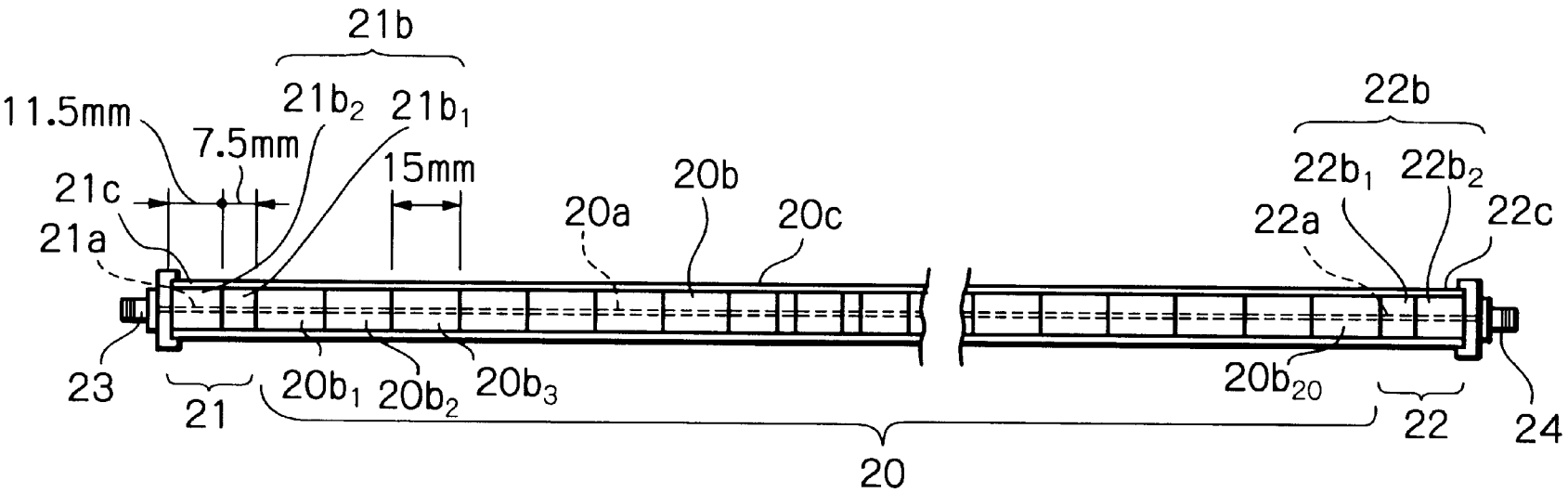
FIG. 2 is a view schematically illustrating a structure of a coaxial cable type delay line component of a preferred embodiment according to the present invention.

FIG. 2 is a view schematically illustrating a structure of a coaxial cable type delay line component of a preferred embodiment according to the present invention.

In the figure, reference number 20 is a main delay line portion of a delay line component, 21 and 22 are coaxial quarter-wavelength (λ/4) transformer portions which are placed at the both ends of the main delay portion 20, and 23 and 24 are input and output connectors which are connected to the λ/4 transformer portions 21 and 22, respectively.

The main delay line portion 20 consists of a center conductor 20*a*, a ceramic dielectric 20*b* which surrounds the center conductor 20*a*, and an outer conductor 20*c* which is formed on the outer surface of the ceramic dielectric 20*b*.

The λ/4 transformer portions 21 and 22 have center conductors 21*a* and 22*a*, ceramic dielectrics 21*b* and 22*b* which surround the center conductors 21*a* and 22*a*, and outer conductors 21*c* and 22*c* which are formed on the outer surfaces of the ceramic dielectrics 21*b* and 22*b* respectively.

The ceramic dielectric 20*b* of the main delay line portion 20 is formed by linking, along the direction of the coaxial axis, twenty block pieces of cylindrical shaped or polygonal tube shaped and sintered ceramic blocks $\mathbf{20}b_1$–$\mathbf{20}b_{20}$ of post molded and sintered dimensions, the outer diameter of 12 mm, the length along the axis of 15 mm, and the center hole diameter of 1.6 mm. The block pieces are made by sintering of press molded ceramic materials which has a large dielectric constant value ∈r=37 and high quality factor Q≧10000.

Each of the ceramic dielectrics of 21*b* and 22*b* of the λ/4 transformer portions 21 and 22 is formed by linking, along the direction of the coaxial axis, two cylindrical shaped or polygonal tube shaped ceramic blocks, $\mathbf{21}b_1$ and $\mathbf{21}b_2$, $\mathbf{22}b_1$, and $\mathbf{22}b_2$, respectively. The ceramic dielectric blocks $\mathbf{21}b_1$ and $\mathbf{22}b_1$ are made from ceramic material of dielectric constant ∈r=23 and post molded and sintered dimensions, the outer diameter of 12 mm, the length along the axis of 7.5 mm, and the center hole diameter of 1.6 mm. The ceramic dielectric blocks $\mathbf{21}b_2$ and $\mathbf{22}b_2$ are made from ceramic material with comparatively smaller dielectric constant ∈r=9 and post molded and sintered dimensions, the outer diameter of 12 mm, the length along the axis of 11.5 mm, and the center hole diameter of 1.6 mm.

After temporally combining the cylindrical shaped or polygonal tube shaped ceramic dielectric blocks, which compose the ceramic dielectric of the main delay line portion 20*b*, and the two ceramic dielectrics 21*b* and 22*b* of λ/4 transformer portions 21 and 22, by glass paste sintering along the coaxial axis, silver paste is filled in the center holes of the ceramic dielectric blocks and sintered at the temperature of silver melting point 960.5° C. This process can minimize the resistance of the center conductor made from silver paste because of non-grain boundary.

The outer conductors 20*c*, 21*c* and 22*c* are formed by sintering of applied silver paste on the surfaces of the ceramic dielectric blocks 20*b*, 21*b* and 22*b* at the usual temperature of paste melting point about 850° C.

Since the ceramic materials for the ceramic dielectric 20*b* in the main delay line portion 20 has a large dielectric constant value ∈r=37 and high quality factor Q≧10000, the characteristic impedance $Z_0$ of the coaxial main delay line is expressed by the following equation, $$Z_0=377/(2\pi\sqrt{\in r})\ln(D/d)$$

where D is the outer diameter of the coaxial main delay line, and d is the inner diameter of the coaxial main delay line. The use of larger dielectric constant ceramic material gives lower characteristic impedance $Z_0$ which is usually difficult for direct connection with another device. Typical characteristic impedance of widely used radio frequency equipment is set to 50 Ω. On the other hand, the characteristic impedance of the delay line component according to the present invention is very low and down to about 20 Ω, because dielectric materials of large dielectric constant and center conductors of large diameter are used. Thus, impedance matching is needed in application of this kind of delay line component. For that purpose of impedance matching, the λ/4 transformer portions 21 and 22 are placed at the both ends of the main delay line portion 20.

In this embodiment of the present invention, each one of the λ/4 transformer portions 21 and 22 is structured by two different dielectric blocks, $\mathbf{21}b_1$ ($\mathbf{22}b_1$) and $\mathbf{21}b_2$ ($\mathbf{22}b_2$), with different dielectric constants for impedance matching. The dielectric blocks $\mathbf{21}b_1$ ($\mathbf{22}b_1$) and $\mathbf{21}b_2$ ($\mathbf{22}b_2$) have different lengths of 7.5 mm and 11.5 mm along the axis so that their lengths are equivalent to λ/4 at the operated frequency. By this structured λ/4 transformer portions 21 and 22, the impedance matching between the delay line component and external devices is done.

In this embodiment of the present invention, also, the ceramic dielectric 20*b* of main delay line portion 20 is made of twenty block pieces of cylindrical shaped or polygonal tube shaped and sintered ceramic blocks along the axis to get 5 to 6 nanoseconds delay time. By increasing the number of cylindrical shaped or polygonal tube shaped ceramic blocks up to a hundred, about 30 nanoseconds delay time can be obtained.

Figure 3:
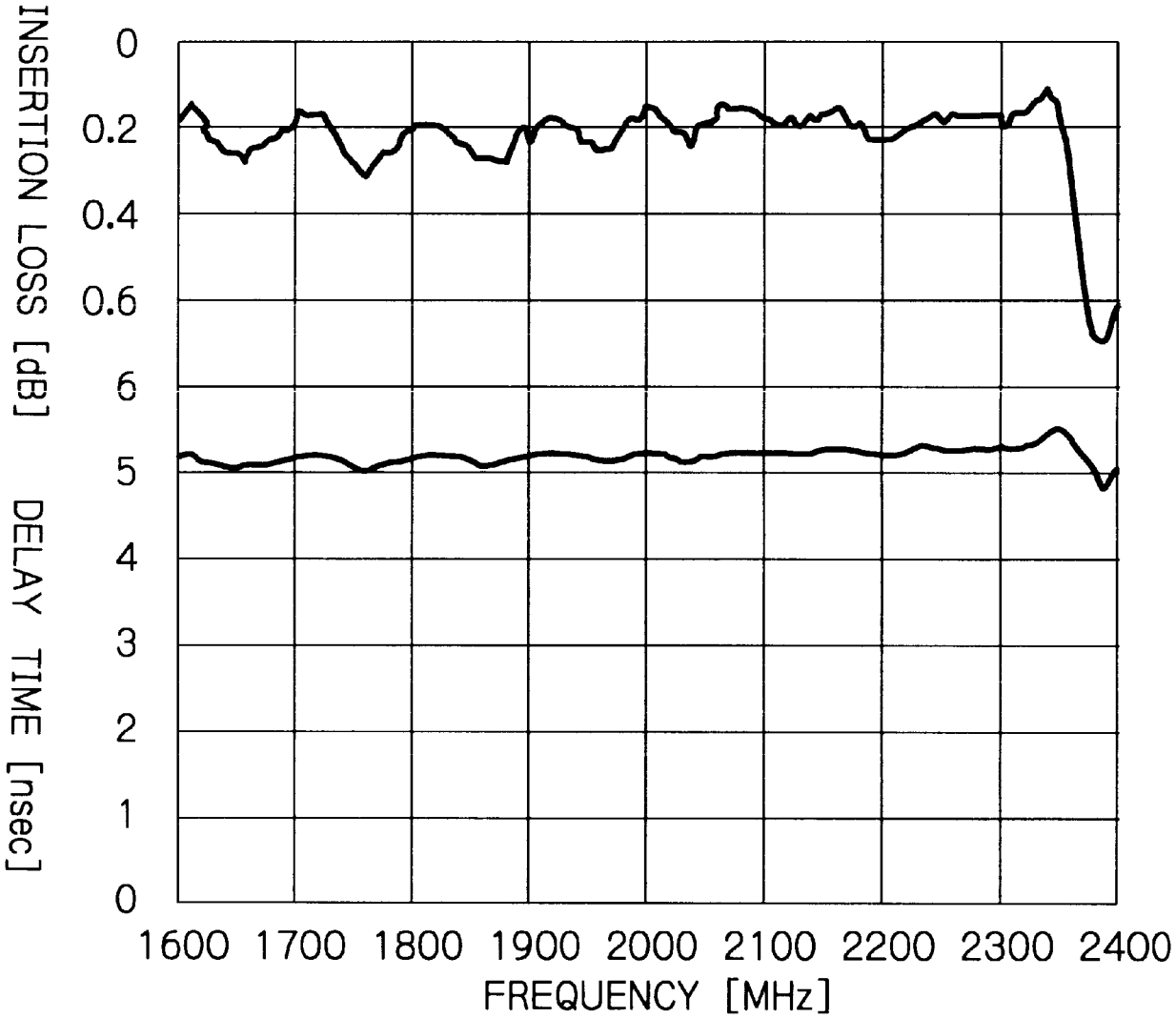
FIG. 3 is a graph illustrating delay time and insertion loss characteristics in the embodiment of FIG. 2.

FIG. 3 illustrates delay time and insertion loss characteristics of the delay line component in the embodiment of FIG. 2.

As will be apparent from the figure, the insertion loss is kept almost constant in a frequency range up to 2300 MHz, which is sufficient to cover the utilized frequency range in a radio frequency power amplifier used in a radio base station for portable phone communication, and a flat delay time of 5 nanoseconds is achieved. One and a half meters length of the delay line according to the present invention is enough to get 30 nanoseconds delay time, and very small form factor of a delay compensation device is resulted.

In the aforementioned embodiment of the present invention, melting sintered silver forms the center conductor. Another metal material like copper is applicable by melting the sintered metal material. And also, pulse-plating method can be applied to form a center conductor on the inside surfaces of the center holes of the ceramic dielectric blocks. In another modification, the center conductor may be formed by rolled thin (thickness of 100 $\mu$m) metal (annealed copper, silver, silver plated aluminum) pipe which is inserted into the center holes of the ceramic dielectric blocks and expanded by static inside pressure by press or explosive gaseous pressure by gunpowder and firmly attached or fixed to the inside surfaces of the center holes of the ceramic dielectric blocks. In this case, it is not necessary to temporally combine the ceramic dielectric blocks by glass paste sintering, while the outer conductors on the ceramic dielectric insulator blocks must be soldered each other. By ,insertion of a solid metal wire such as a solid copper, silver or aluminum wire into the center holes of the ceramic dielectric blocks, the center conductor can be formed.

In the aforementioned embodiment of the present invention, silver paste sintering is used to form the outer conductors on the surfaces of the ceramic dielectric blocks. However, in modification, the coaxial outer conductor may be formed by covering the ceramic dielectric insulator blocks with a heated and thermally expanded metal pipe of copper, silver or aluminum whose inner diameter is slightly smaller than the outer diameter of the ceramic dielectric blocks at room temperature. Electroless plating method is applicable to form the outer conductor.

As for the $\lambda/4$ transformer portions, there are many different types of configurations.

Figure 4:
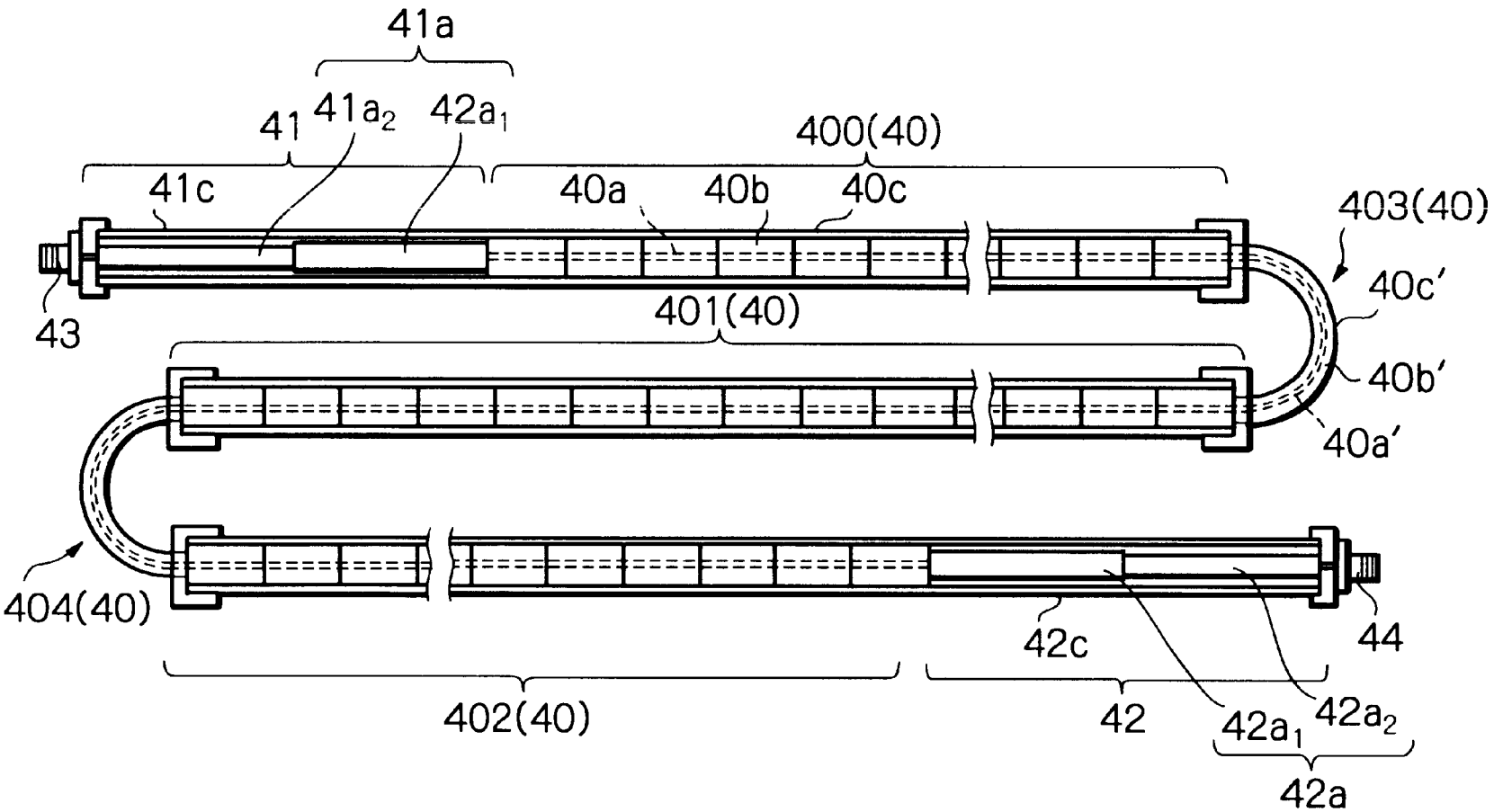
FIG. 4 is a view schematically illustrating a structure of a coaxial cable type delay line component of another embodiment according to the present invention.

FIG. 4 schematically illustrates a structure of a coaxial cable type delay line component of another embodiment according to the present invention.

In the figure, reference number 40 is a main delay line portion of the delay line component, 41 and 42 are $\lambda/4$ transformer portions which are placed at the both ends of the main delay line portion 40, 43 and 44 are input and output connectors which are connected to the $\lambda/4$ transformer portions 41 and 42, respectively.

The main delay line portion 40 is folded up to get larger delay time by smaller form factor, and consequently it consists of three straight coaxial cable lines 400, 401 and 402, and two curved coaxial cable lines 403 and 404.

Each of the straight coaxial cable lines 400, 401 and 402 of the main delay line portion 40 consists of a center conductor 40*a*, a ceramic dielectric 40*b* which surrounds the center conductor 40*a*, and an outer conductor 40*c* which is formed on the outer surface of the ceramic dielectric 40*b*.

Each of the curved coaxial cable lines 403 and 404 of the main delay line portion 40 consists of a center conductor 40*a*', a dielectric 40*b*' which surrounds the center conductor 40*a*', and an outer conductor 40*c*' which is formed on the outer surface of the dielectric 40*b*'.

The $\lambda/4$ transformer portions 41 and 42 have center conductors 41*a* and 42*a*, and outer conductors 41*c* and 42*c* which surround the center conductors 41*a* and 42*a* with air gap.

The ceramic dielectric 40*b* of the straight coaxial cable lines 400, 401 and 402 of the main delay line portion 40 is formed by linking, along the direction of the coaxial axis, twenty block pieces of cylindrical shaped or polygonal tube shaped and sintered ceramic blocks of post molded and sintered dimensions, the outer diameter of 6 mm, the length along the axis of 15 mm, and the center hole diameter of 1.0 mm. Each of the blocks is made by sintering of press molded ceramic materials which has large dielectric constant value $\in r=92$ and high quality factor $Q \geqq 7000$.

An elastic resin type dielectric insulator, which includes ceramic particles of large dielectric constant $\in r=10$ is used for the dielectric insulator 40*b*' of the curved coaxial cable lines 403 and 404 other than rigid sintered ceramic because of the necessity of keeping resistivity against mechanical vibration and impact shock. A metal pipe such as copper, silver or aluminum pipe is used as the outer conductor 40*c*'. The curved coaxial cable lines 403 and 404 are formed so that the characteristic impedance thereof is matched with that of each of the straight coaxial cable lines 400, 401 and 402.

In this embodiment of the present invention in FIG. 4, there is no dielectric material in the $\lambda/4$ transformer portions 41 and 42 but air between the center and outer conductors.

The center conductors 40*a* and 40*a*' of the main delay line portion 40 are formed by rolled thin (thickness of 100 $\mu$m) metal (annealed copper, silver, silver plated aluminum) pipe, which is inserted into the center holes of the ceramic dielectric 40*b* of cylindrical shaped or polygonal tube shaped and sintered ceramic blocks and the attached dielectric 40*b*'. The metal pipe is expanded by static inside pressure by press or explosive gaseous pressure by gunpowder and firmly attached or fixed to the inside surfaces of the center holes of the dielectric blocks. This process can minimize the resistance of the center conductor made from silver paste because of non-grain boundary.

The center conductors 41*a* and 42*a* of the $\lambda/4$ transformer portions 41 and 42 are made of solid metal cylinders with two staged different diameters 41$a_1$ and 41$a_2$, 42$a_1$ and 42$a_2$, respectively.

The outer conductor 40*c* of the straight coaxial cable lines 400, 401 and 402 of the main delay line portion 40 is formed by covering the ceramic dielectric blocks with a heated and thermally expanded metal pipe such as copper, silver or aluminum pipe whose inner diameter is slightly smaller than the outer diameter of the ceramic dielectric insulator at room temperature. The dimensions of the metal pipe and the heating temperature are to be defined reflecting the operating temperature under actual application conditions. The outer conductors 41*c* and 42*c* of the $\lambda/4$ transformer portions 41 and 42 are formed by extending the metal pipe.

The use of larger dielectric constant ($\in r=92$, quality factor $Q \geqq 7000$) ceramic material as the ceramic dielectric insulator 40*b* of the main delay line portion 40 gives lower characteristic impedance $Z_0$ which is usually difficult for direct connection with another device as in the previously described embodiment of the present invention shown in FIG. 3. Typical characteristic impedance of widely used radio frequency equipments is 50 Ω. On the other hand, the characteristic impedance of the delay line component according to the present invention is very low and down to 11.2 Ω, because dielectric materials of large dielectric constant is used and center conductors of large diameter is used in order to decrease the insertion loss. Thus, impedance matching is needed in actual applications of this kind of delay line component. For that purpose of impedance matching, the $\lambda/4$ transformer portions 41 and 42 are placed at the both ends of the main delay line portion 40.

In this embodiment of the present invention in FIG. 4, each of the $\lambda/4$ transformer portions 41 and 42 has metal cylinders with two staged different diameters and with lengths along the axis which are chosen to be equivalent to their $\lambda/4$ at operating frequency. By these configured $\lambda/4$ transformer portions, impedance matching between the delay line component and external devices can be done.

In this embodiment, the ceramic dielectric 40*b* of each of the straight coaxial cable lines 400, 401 and 402 of the main delay line portion 40 is made of twenty block pieces of cylindrical shaped or polygonal tube shaped ceramic blocks which are linked along the axis. By using three of these straight coaxial lines which are serially connected, about 30 nanoseconds of delay time can be obtained.

In this embodiment of the present invention shown in FIG. 4, the center conductor is formed by rolled thin (thickness of 100 $\mu$m) metal (annealed copper, silver, silver plated aluminum) pipe, which is inserted into the center holes of the ceramic dielectric blocks and is expanded by static inside pressure by press or explosive gaseous pressure by gunpowder and firmly attached or fixed to the inside surfaces of the center holes of the ceramic dielectric blocks. However, as well as done in the embodiment shown in FIG. 2, this center conductor can be formed by melting and then by sintering silver, copper or another metal paste filled inside the center holes of the ceramic dielectric blocks. By insertion of a solid metal wire such as a solid copper, silver or aluminum wire into the center holes of the ceramic dielectric insulator blocks, the center conductor can be formed. And also pulse-plating method can be applied to form a center conductor on the inside surfaces of the center holes of the ceramic dielectric blocks.

Also, in this embodiment of the present invention shown in FIG. 4, covering the ceramic dielectric blocks with a heated and thermally expanded metal pipe forms the coaxial outer conductor. However, in modification, sintering of silver paste on the surfaces of the ceramic dielectric blocks and soldering them together may form the outer conductors. If the ceramic dielectric blocks are integral with each other by glass paste sintering, such soldering is not necessary. Electroless plating method is also applicable to form the outer conductor.

The $\lambda/4$ transformer portions can be structured as shown in FIG. 2, or in FIGS. 5 and 6 which will be described later.

Figure 5:
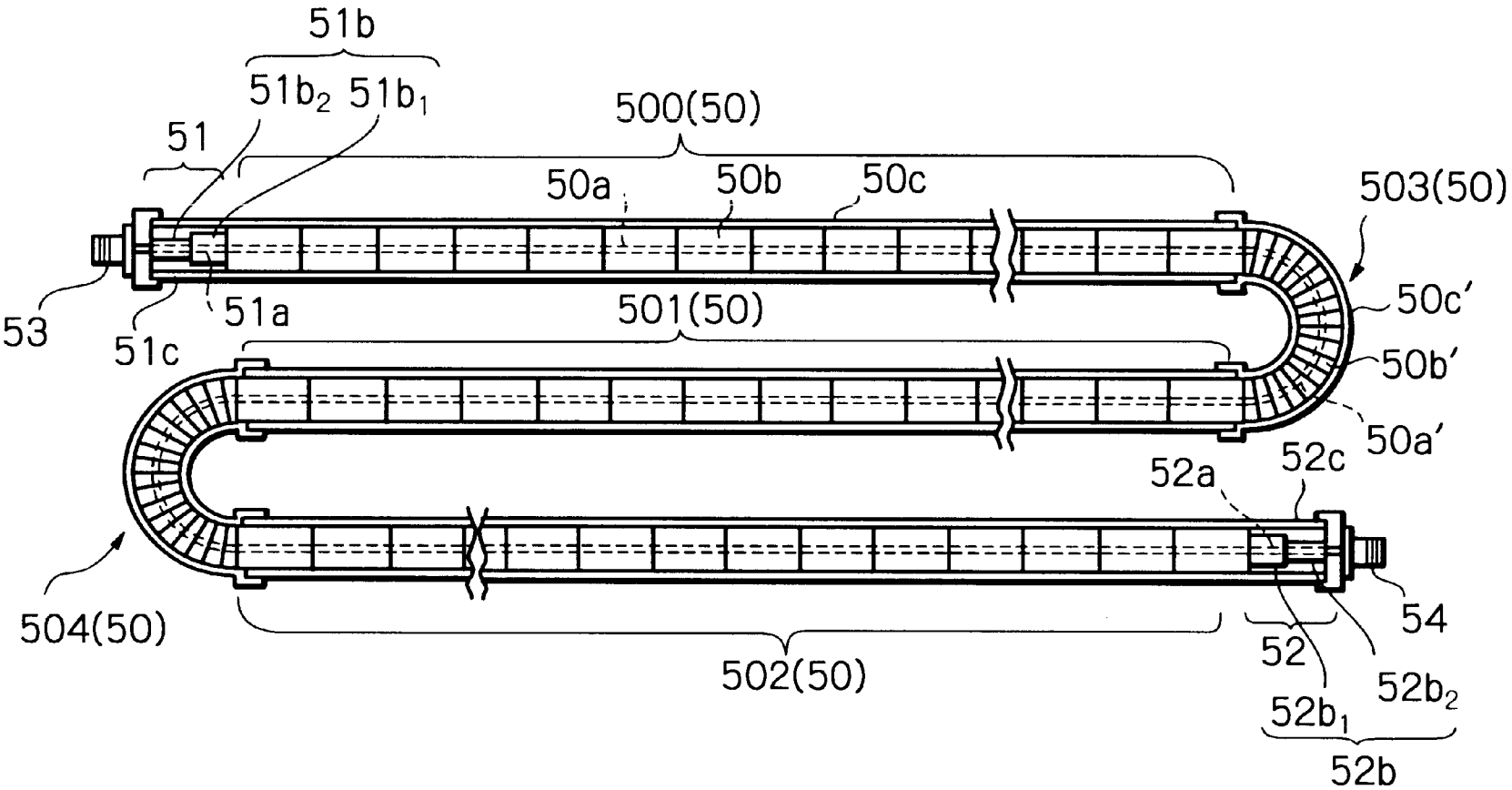
FIG. 5 is a view schematically illustrating a structure of a coaxial cable type delay line component of further embodiment according to the present invention.

FIG. 5 schematically illustrates a structure of a coaxial cable type delay line component of further embodiment according to the present invention.

In the figure, reference number 50 is a main delay line portion of the delay line component, 51 and 52 are $\lambda/4$ transformer portions which are placed at the ends of the main delay portion 50, 53 and 54 are input and output connectors which are connected to $\lambda/4$ transformer portions 51 and 52, respectively.

The main delay line portion 50 is folded up to get larger delay time by smaller form factor, and consequently it consists of three straight coaxial cable lines 500, 501 and 502, and two curved coaxial cable lines 503 and 504 for serially connecting the three straight coaxial cable lines 500, 501 and 502.

Each of the straight coaxial cable lines 500, 501 and 502 of the main delay line portion 50 consists of a center conductor 50*a*, a ceramic dielectric 50*b* which surrounds the center conductor 50*a*, and an outer conductor 50*c* which is formed on the outer surface of the ceramic dielectric 50*b*.

Each of the curved coaxial cable lines 503 and 504 of the main delay line portion 50 consists of a center conductor 50*a*', a dielectric 50*b*' which surrounds the center conductor 50*a*', and an outer conductor 50*c*' which is formed on the outer surface of the dielectric 50*b*'.

The $\lambda/4$ transformer portions 51 and 52 have center conductors 51*a* and 52*a*, ceramic dielectrics 51*b* and 52*b* which surround the center conductors 51*a* and 52*a*, and outer conductors 51*c* and 52*c* which are formed outside the ceramic dielectrics 51*b* and 52*b*, respectively.

The ceramic dielectric 50*b* of the straight coaxial cable lines 500, 501 and 502 of the main delay line portion 50 is formed by linking, along the direction of the coaxial axis, twenty block pieces of cylindrical shaped or polygonal tube shaped and sintered ceramic blocks of post molded and sintered dimensions, the outer diameter of 6 mm, the length along the axis of 15 mm, and the center hole diameter of 1.0 mm. Each of the blocks is made by sintering of press molded ceramic materials which has large dielectric constant value $\in r=92$ and high quality factor $Q \geqq 7000$.

In modification, a resin including ceramic particles of large dielectric constant may be used as the dielectric material of the coaxial cable lines. In this case, to get a large value of relative dielectric constant like $\in r=92$ is difficult, consequently physical design of such delay line must be done assuming lower relative dielectric constant value.

The ceramic dielectric 50*b*' of the curved coaxial cable lines 503 and 504 of the main delay line portion 50 is formed by linking, along the direction of the coaxial axis, eighteen block pieces of cylindrical shaped or polygonal tube shaped and sintered ceramic blocks of post molded and sintered dimensions, the outer diameter of 6 mm and the center hole diameter of 1.0 mm. Each block is made by sintering of press molded ceramic materials which has large dielectric constant value $\in r=92$ and high quality factor $Q \geqq 7000$. Each of the ceramic blocks is in fact reshaped after press molding to make a curved center hole along the curved axis of the coaxial cable line. In modification, the block may be formed by press molding in half pieces divided by a plane which passes the axis and by putting together the press-molded half pieces.

In this embodiment, the ceramic dielectrics of 51*b* and 52*b* of the $\lambda/4$ transformer portions 51 and 52 are made of stacked two cylindrical shaped or polygonal tube shaped ceramic dielectric blocks along the axis, $\mathbf{51}b_1$ and $\mathbf{51}b_2$, $\mathbf{52}b_1$ and $\mathbf{52}b_2$ respectively. The ceramic dielectric blocks $\mathbf{51}b_1$and $\mathbf{52}b_1$ are made from ceramic material with large dielectric constant and post sintered dimensions, an outer diameter of smaller than 6.0 mm, and the center hole diameter of 1.0 mm. The ceramic dielectric blocks $\mathbf{51}b_2$ and $\mathbf{52}b_2$ are also made similarly with post sintered dimensions, an outer diameter of smaller than that of the blocks $\mathbf{51}b_1$ and $\mathbf{52}b_1$, and the center hole diameter of 1.0 mm. Therefore, the effective dielectric constants of the transformers are comparatively smaller than that of the main delay line portion 50 due to composite structures of air and ceramic dielectric, and consequently the characteristic impedance becomes higher.

The center conductors 50*a* and 50*a*' of the main delay line portion 50 and the center conductors 51*a* and 52*a* of the $\lambda/4$ transformer portions 51 and 52 are formed by rolled thin (thickness of 100 $\mu$m) metal (annealed copper, silver, silver plated aluminum) pipe, which is inserted into the center holes of the ceramic dielectric 50*b* and 50*b*' of cylindrical shaped or polygonal tube shaped ceramic blocks. The metal pipe is expanded by static inside pressure by press or explosive gaseous pressure by gunpowder and firmly attached or fixed to the inside surfaces of the center holes of the dielectric insulators. This process can minimize the resistance of the center conductor made from silver paste minimized because of non-grain boundary.

The outer conductors 50*c* and 50*c*' of the main delay line portion 50 is formed by covering the ceramic dielectric blocks with a heated and thermally expanded metal pipe of copper, silver or aluminum whose inner diameter is slightly smaller than the outer diameter of the ceramic dielectric insulator at room temperature. The dimensions of the metal pipe and the heating temperature are to be defined reflecting the operating temperature under actual application conditions. The outer conductors 51*c* and 52*c* of the λ/4 transformer portions 51 and 52 are formed by extending the metal pipe.

The use of larger dielectric constant (∈r=92, quality factor Q≧7000) ceramic material as the ceramic dielectric insulators 50*b* and 50*b*' of the main delay line portion 50 gives lower characteristic impedance $Z_0$ which is usually difficult for direct connection with another device as in the previously described embodiment of the present invention shown in FIG. 4. Typical characteristic impedance of widely used radio frequency equipments is 50 Ω. On the other hand, the characteristic impedance of the delay line component according to the present invention is very low and down to 11.2 Ω, because dielectric materials of large dielectric constant and center conductors of large diameter are used. Impedance matching is needed in actual applications of this kind of delay line component. For that purpose of impedance matching, the λ/4 transformer portions 51 and 52 are placed at the both ends of the main delay line portion 50.

In this embodiment of the present invention in FIG. 5, each of the λ/4 transformer portions 51 and 52 has two ceramic dielectric cylinders whose outer diameters are different each other and lengths along the axis are chosen to be equivalent to their λ/4 at operating frequency. By these configured λ/4 transformer portions, impedance matching between the delay line component and external device can be done.

In this embodiment, the ceramic dielectric 50*b* of the straight coaxial cable lines 500, 501 and 502 of the main delay line portion 50 is formed by linking, along the direction of the coaxial axis, twenty block pieces of cylindrical shaped or polygonal tube shaped and sintered ceramic blocks. By using three of these straight coaxial lines which are serially connected, about 30 nanoseconds of delay time can be obtained.

In the embodiment of the present invention shown in FIG. 5, the center conductor is formed by rolled thin (thickness of 100 μm) metal (annealed copper, silver, silver plated aluminum) pipe, which is inserted into the center holes of the ceramic dielectric blocks and is expanded by static inside pressure by press or explosive gaseous pressure by gunpowder and firmly attached or fixed to the inside surfaces of the center holes of the ceramic dielectric blocks. In modification, however, this center conductor can be formed by melting sintered silver, copper or another metal paste filled inside the center holes of the ceramic dielectric blocks if the ceramic dielectric blocks are not made of ceramic particle mixed resin dielectric. By insertion of a solid metal wire into the center holes of the ceramic dielectric insulator blocks, the center conductor can be formed. Also, pulse-plating method can be applied to form a center conductor on the inside surfaces of the center holes of the ceramic dielectric blocks.

In this embodiment of the present invention shown in FIG. 5, covering the ceramic dielectric blocks with a heated and thermally expanded metal pipe forms the coaxial outer conductor. However, in modification, sintering of silver paste on the surfaces of the ceramic dielectric blocks if the ceramic dielectric blocks are not made of ceramic particle mixed resin dielectric may form the outer conductors. Electroless plating method is also applicable to form the outer conductor.

The λ/4 transformer portions can be structured as shown in FIGS. 2 and 4, or in FIG. 6 which will be described later.

Figure 6:
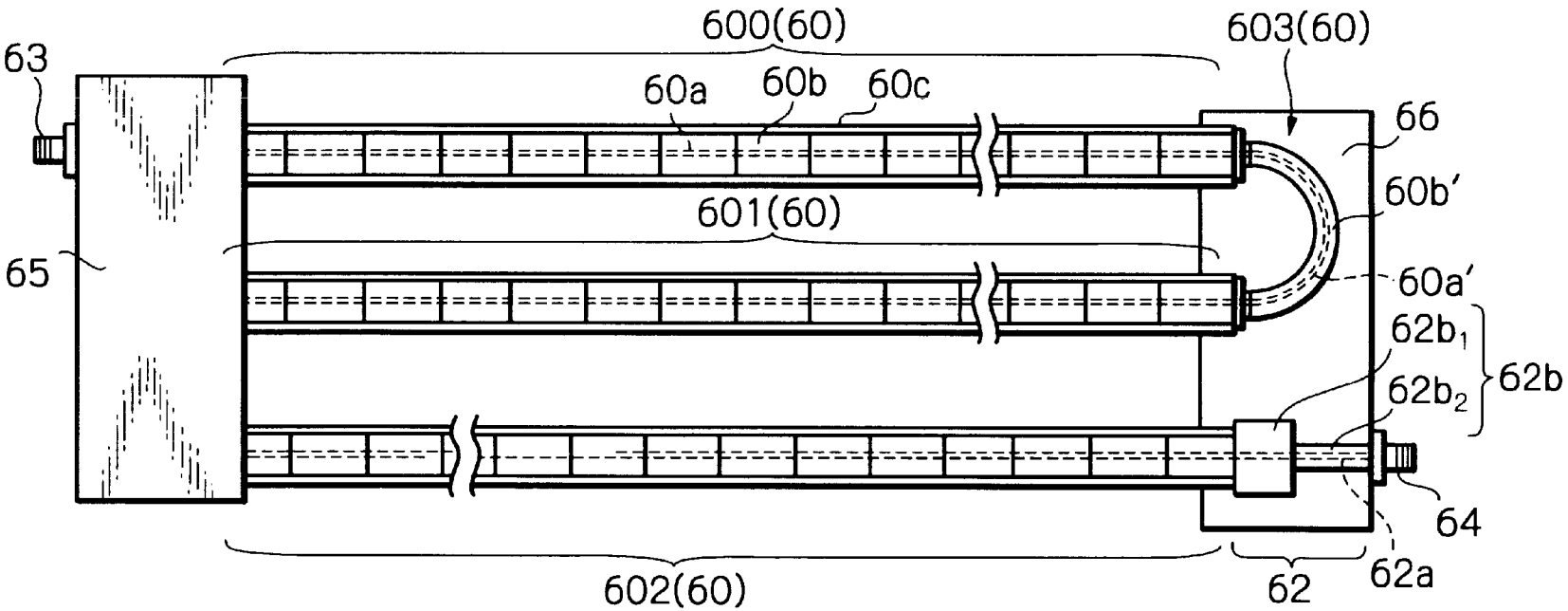
FIG. 6 is a view schematically illustrating a structure of a coaxial cable type delay line component of still further embodiment according to the present invention.

FIG. 6 illustrates a structure of a coaxial cable type delay line component of still further embodiment according to the present invention.

In the figure, reference number 60 is a main delay line portion of the delay line component, 62 is a λ/4 transformer portion which is placed at an end of the main delay line portion 60, 63 and 64 are input and output connectors which are connected to λ/4 transformer portions respectively, and 65 and 66 are metal blocks. Although it is not shown in FIG. 6, there is another λ/4 transformer portion at the other of the main delay line portion.

The main delay line portion 60 is folded up to get larger delay time by smaller form factor, and consequently it consists of three straight coaxial cable lines 600, 601 and 602, and two curved coaxial cable lines (only one curved coaxial cable line 603 is shown in FIG. 6) for serially connecting the three straight coaxial cable lines 600, 601 and 602.

Each of the straight coaxial cable lines 600, 601 and 602 of the main delay line portion 60 consists of a center conductor 60*a*, a ceramic dielectric 60*b* which surrounds the center conductor 60*a*, and an outer conductor 60*c* which is formed on the outer surface of the ceramic dielectric 60*b*. The curved coaxial cable line 603 of the main delay line portion 60 consists of a center conductor 60*a*', a dielectric 60*b*' which surrounds the center conductor 60*a*', and the metal block 66 as the outer conductor which surrounds the dielectric 60*b*'. The other curved coaxial cable line is also similarly built.

The λ/4 transformer portion 62 consists of a center conductor 62*a*, a ceramic dielectrics 62*b* which surrounds the center conductors 62*a*, and the metal block 66 as the outer conductor which surrounds the dielectric 62*b*'. The other λ/4 transformer portion is also similarly built.

The ceramic dielectric 60*b* of the straight coaxial cable lines 600, 601 and 602 of the main delay line portion 60 is formed by linking, along the direction of the coaxial axis, twenty block pieces of cylindrical shaped or polygonal tube shaped and sintered ceramic blocks of post molded and sintered dimensions, the outer diameter of 6 mm, the length along the axis of 15 mm, and the center hole diameter of 1.0 mm. Each of the blocks is made by sintering of press molded ceramic materials which has large dielectric constant value ∈r=92 and high quality factor Q≧7000.

In modification, a resin including ceramic particles of large dielectric constant may be used as the dielectric material of the coaxial cable lines.

The ceramic dielectric 60*b*' of the curved coaxial cable lines 603 of the main delay line portion 60 is formed by a cylindrical shaped or polygonal tube shaped ceramic block with the center hole diameter of 1.0 mm. The ceramic materials also has large dielectric constant value ∈r=92 and high quality factor Q≧7000. Actually, the ceramic dielectric 60*b*' is formed by filling ceramic dielectric in trenches of semi-circular or semi-polygonal cross section which are semi-circularly dug on two divided half metal blocks and by combining the half metal blocks. In a modification, an elastic resin type dielectric insulator including ceramic particles of large dielectric constant whose effective dielectric constant ∈r=10, may be used for the dielectric insulator 60*b*' of the coaxial cable line 603 other than rigid sintered ceramic because of the necessity of keeping resistivity against mechanical vibration and impact shock.

In this embodiment, the ceramic dielectric of 62*b* of the λ/4 transformer portion 62 is made of stacked two cylindrical shaped or polygonal tube shaped ceramic dielectric blocks along the axis, $62b_1$ and $62b_2$, respectively. The ceramic dielectric block $62b_1$ is made from ceramic material with large dielectric constant and post sintered dimensions, an outer diameter of larger than 6.0 mm, and the center hole diameter of 1.0 mm. The ceramic dielectric blocks 62$b_2$ is also made similarly with post sintered dimensions, an outer diameter of smaller than that of the block 62$b_1$, and the center hole diameter of 1.0 mm.

The center conductors 60*a* and 60*a*' of the main delay line portion 60 and the center conductors of the λ/4 transformer portions are formed by insertion of a solid metal wire into the center hole of the ceramic dielectric of cylindrical shaped or polygonal tube shaped ceramic blocks which are linked along the coaxial axis. By this process, the resistance of the center conductor made of a solid continued metal wire of non-grain boundary can be minimized and this process obtains very small insertion loss.

The outer conductor 60*c* of each of the straight coaxial cable lines 600, 601 and 602 of the main delay line portion 60 is formed by covering the ceramic dielectric blocks with a heated and thermally expanded metal pipe of copper, silver or aluminum whose inner diameter is slightly smaller than the outer diameter of the ceramic dielectric insulator at room temperature. The dimensions of the metal pipe and the heating temperature are to be defined reflecting the operating temperature under actual application conditions. The outer conductors of the curved coaxial cable line 603 and the λ/4 transformer portion 62 are formed by the metal block 66 as previously described.

The manufacturing method in this embodiment of the present invention is as follows. First, a silver plated copper solid wire as a center conductor, coaxial ceramic dielectric blocks for straight coaxial cable lines of the main delay line portion, and a copper pipe as outer conductors are assembled. Then, two parts of the copper solid wire are bent for the center conductor of curved coaxial cable lines using a jig. Thereafter, the curved coaxial cable line is assembled by combining two divided metal blocks, on which trenches of semi-circular or semipolygonal cross section are semi-circularly dug and ceramic dielectric is filled, and sandwiching the bent copper wire portions as the center conductor. At the both ends of the transmission line of the main delay line portion 60, λ/4 transformer portions are placed. These transformer portions are also built in the metal blocks 65 and 66.

The use of larger dielectric constant (∈r=92, quality factor Q≧7000) ceramic material as the ceramic dielectric insulators 60*b* and 60*b*' of the main delay line portion 60 gives lower characteristic impedance $Z_0$ which is usually difficult for direct connection with another device as in the previously described embodiment of the present invention shown in FIG. 5.

Typical characteristic impedance of widely used radio frequency equipments is 50 Ω. On the other hand, the characteristic impedance of the delay line component according to the present invention is very low and down to 11.2 Ω, because dielectric materials of large dielectric constant and center conductors of large diameter are used. Impedance matching is needed in actual applications of this kind of delay line component. For that purpose of impedance matching, λ/4 transformer portions are placed at the both ends of the main delay line portion 60.

In this embodiment of the present invention in FIG. 6, each of the λ/4 transformer portions has two different diameter ceramic dielectric cylinders with air gaps whose lengths along the axis are chosen to be equivalent to their λ/4 at operating frequency. By these configured λ/4 transformer portion, impedance matching between the delay line component and external device can be done.

In this embodiment, the ceramic dielectric 60*b* of the straight coaxial cable lines 600, 601 and 602 of the main delay line portion 60 is formed by linking, along the direction of the coaxial axis, twenty block pieces of cylindrical shaped or polygonal tube shaped and sintered ceramic blocks. By using three of these straight coaxial lines which are serially connected, about 30 nanoseconds of delay time can be obtained.

In the embodiment of the present invention shown in FIG. 6, the center conductor is formed by insertion of a solid metal wire into the center hole of the ceramic dielectric of cylindrical shaped or polygonal tube shaped ceramic blocks which are linked along the coaxial axis. In modification, however, this center conductor can be formed by melting sintered silver, copper or another metal paste filled inside the center holes of the ceramic dielectric blocks if the ceramic dielectric blocks are not made of ceramic particle mixed resin dielectric. The center conductor may be formed by rolled thin (thickness of 100 μm) metal (annealed copper, silver, silver plated aluminum) pipe, which is inserted into the center holes of the ceramic dielectric blocks and is expanded by static inside pressure by press or explosive gaseous pressure by gunpowder and firmly attached or fixed to the inside surfaces of the center holes of the ceramic dielectric blocks. Also, pulse-plating method can be applied to form a center conductor on the inside surfaces of the center holes of the ceramic dielectric blocks.

In this embodiment of the present invention shown in FIG. 6, covering the ceramic dielectric blocks with a heated and thermally expanded metal pipe forms the coaxial outer conductor. However, in modification, sintering of silver paste on the surfaces of the ceramic dielectric blocks if the ceramic dielectric blocks are not made of ceramic particle mixed resin dielectric may form the outer conductors. Electroless plating method is also applicable to form the outer conductor.

The λ/4 transformer portions can be structured as shown in FIGS. 2, 4 and 5.

Figure 7:
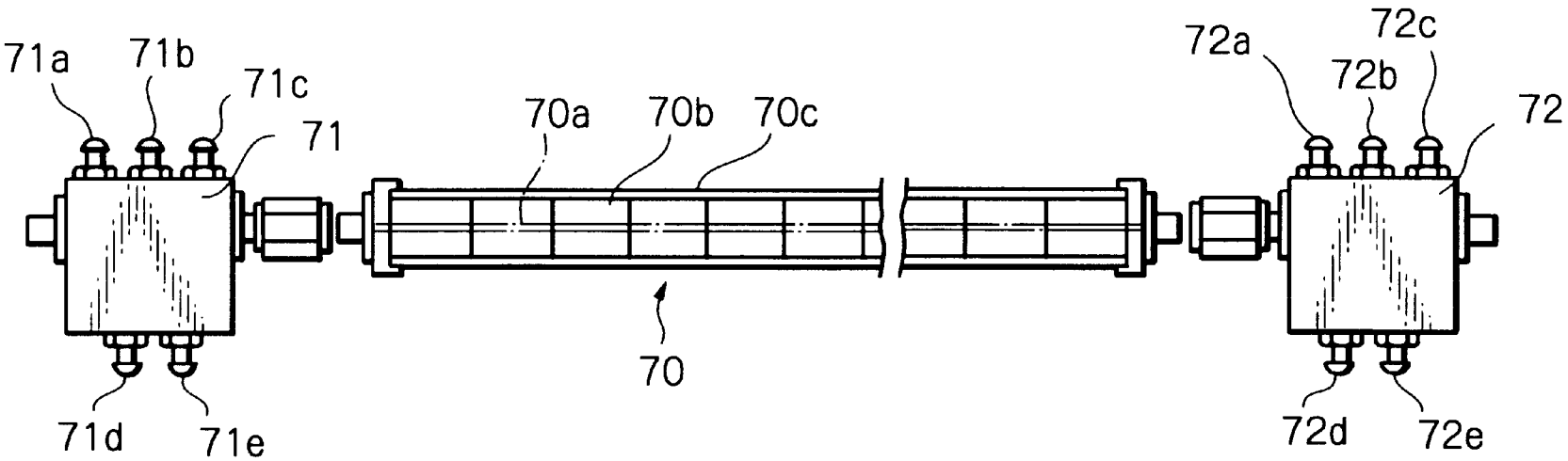
FIG. 7 is a view schematically illustrating a structure of a coaxial cable type delay line component of further embodiment according to the present invention.

FIG. 7 schematically illustrates a structure of a coaxial cable type delay line component of further embodiment according to the present invention.

In the figure, reference number 70 is a delay line component, 71 and 72 are band pass filters which are placed at the both ends of the delay line component 70.

The delay line component 70 is almost similar with the main delay line portion 20 shown in FIG. 2. The delay line component 70 consists of a center conductor 70*a*, a ceramic dielectric 70*b* which surrounds the center conductor 70*a*, and an outer conductor 70*c* which is formed on the outer surface of the ceramic dielectric 70*b*.

The band pass filters are designed with feature of a function of adjusting frequency characteristics.

The ceramic dielectric 70*b* of the main delay line portion 70 is formed by linking, along the direction of the coaxial axis, twenty block pieces of cylindrical shaped or polygonal tube shaped and sintered ceramic blocks of post molded and sintered dimensions, the outer diameter of 12 mm, the length along the axis of 15 mm, and the center hole diameter of 1.6 mm. Each of the blocks is made by sintering of press molded ceramic materials which has large dielectric constant value ∈r=37 and high quality factor Q≧10000.

Using of the ceramic dielectric blocks of high temperature resistivity as for the dielectric material can realize sintering of silver paste for formation of center and outer conductors. However, ceramic particles mixed resin materials are applicable for the dielectric material, if low temperature assemble processing is applied.

After temporally fixing the cylindrical shaped or polygonal tube shaped ceramic dielectric blocks, which compose the ceramic dielectric 70*b* of the main delay line portion 70, by glass paste sintering along the coaxial axis, silver paste is filled in the center holes of the ceramic dielectric blocks and then sintered at the temperature of silver melting point 960.5° C. This process can minimize the resistance of the center conductor made from silver paste minimized because of non-grain boundary.

The outer conductors 70*c* is formed by sintering of applied silver paste on the surfaces of the ceramic dielectric blocks of dielectric 70*b* at the usual temperature of silver paste melting point about 850° C.

Figure 8:
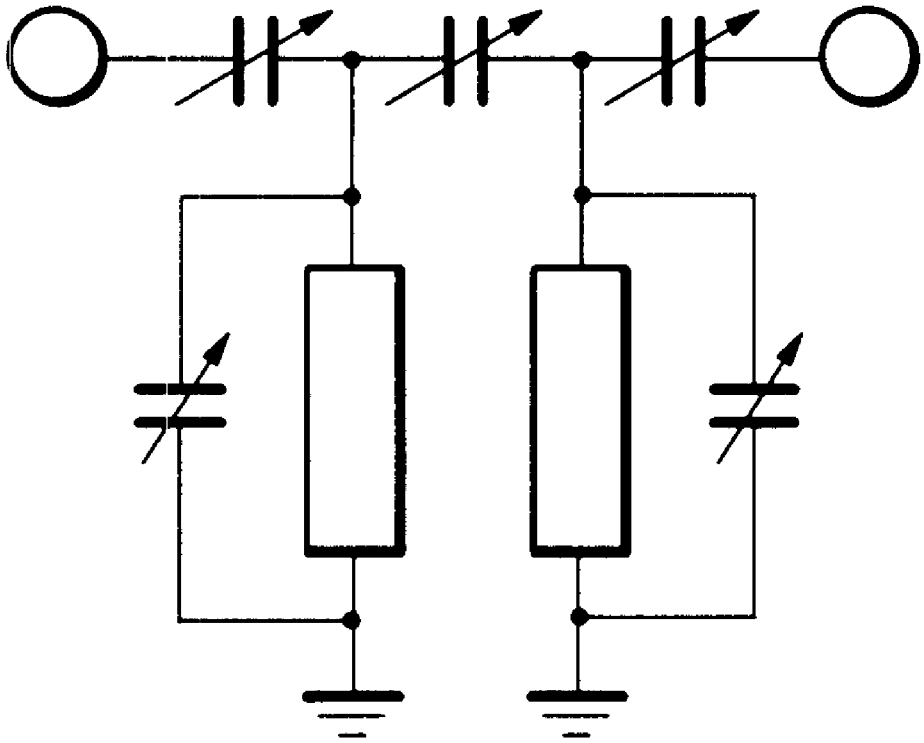
FIG. 8 is a circuit diagram of an example of each band pass filter used in the embodiment of FIG. 7.

FIG. 8 illustrates a schematic example of the band pass filters 71 and 72 which are used in the delay compensation device shown in FIG. 7.

As will be apparent from the figure, each of the band pass filters 71 and 72 is a filter which consists of capacity coupled two staged resonators of ceramic dielectrics. By adjusting screws 71*a*–71*e* and 72*a*–72*e* shown in FIG. 7, capacitance values of the filter can be changed, and consequently the frequency transfer characteristics can be controlled.

A typical radio frequency power amplifier has a frequency transfer characteristic of single-humped or double-humped resonance curve. The band pass filters 71 and 72 are adjusted to get maximally flat type or Chebyshev type curve, and thus the overall frequency transfer characteristic of the radio frequency power amplifier with the delay compensation device which includes these band pass filters can be compensated.

Figure 9:
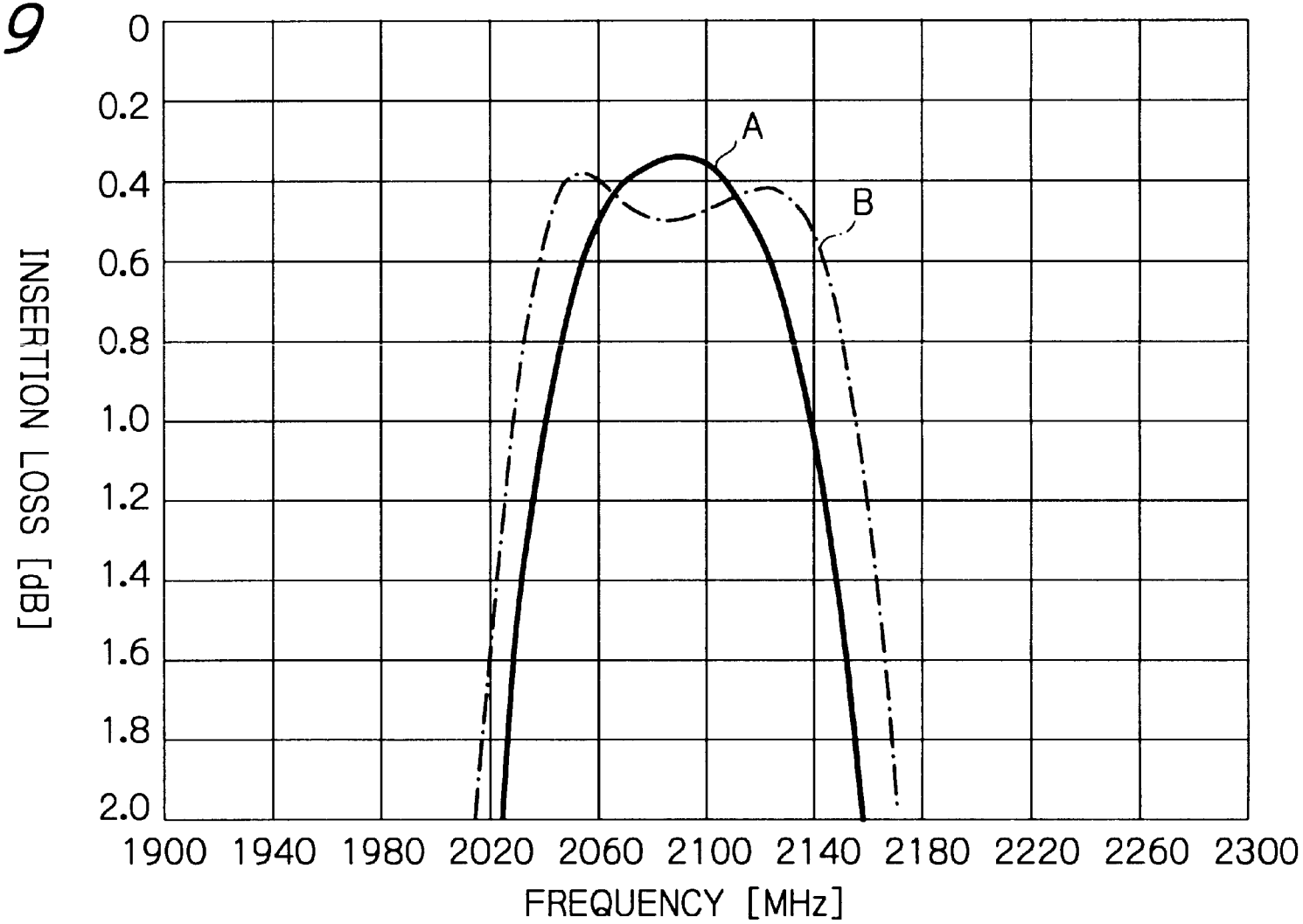
FIG. 9 is a graph for comparing possible range of adjustable frequency transfer characteristics of the delay compensation device in the embodiment of FIG. 7.

FIG. 9 compares possible range of adjustable frequency transfer characteristics of the delay compensation device in the embodiment of FIG. 7. As will be understood, by adjusting the frequency transfer characteristic curve between the solid line A and the dot-dash-line B or by selecting a filter for a proper transfer characteristic, the overall frequency transfer characteristic of the radio frequency power amplifier can be easily adjusted to a flat curve.

The use of larger dielectric constant ($\in r=37$, quality factor $Q \geqq 10000$) ceramic material as the ceramic dielectric insulator 70*b* of the main delay line portion 70 gives lower characteristic impedance $Z_0$ which is usually difficult for direct connection with another device as in the previously described embodiment of the present invention shown in FIG. 6. Typical characteristic impedance of widely used radio frequency equipments is 50 Ω. On the other hand, the characteristic impedance of the delay line component according to the present invention is very low and down to 20 Ω, because dielectric materials of large dielectric constant and center conductors of large diameter for small insertion loss are used. Impedance matching is needed in actual applications of this kind of delay line component. The band pass filters 71 and 72 are designed to have different input and output impedance so that a way for impedance matching is provided, and they are placed at the both ends of the main delay line portion 70.

In this embodiment of the present invention shown in FIG. 7, the ceramic dielectric insulator 70*b* of main delay line portion 70 is formed by linking, along the direction of the coaxial axis, twenty block pieces of cylindrical shaped or polygonal tube shaped and sintered ceramic blocks to get 5 to 6 nanoseconds delay time. By increasing the number of cylindrical shaped or polygonal tube shaped ceramic dielectric blocks up to one hundred, about 30 nanoseconds delay time is obtained.

In this embodiment of the present invention, melting sintered silver forms the center conductor. In modification, another metal material like copper is applicable. In further modification, the center conductor may be formed by rolled thin (thickness of 100 μm) metal (annealed copper, silver, silver plated aluminum) pipe which is inserted into the center holes of the ceramic dielectric blocks and expanded by static inside pressure by press or explosive gaseous pressure by gunpowder and firmly attached or fixed to the inside surfaces of the center holes of the ceramic dielectric blocks. In still further modification, the center conductor may be formed by insertion of a solid metal wire into the center holes of the ceramic dielectric blocks. And also pulse-plating method may be applied to form a center conductor on the inside surfaces of the center holes of the ceramic dielectric blocks.

In the embodiment of the present invention, silver paste sintering is used to form the outer conductors on the surfaces of the ceramic dielectric blocks. In modification, the coaxial outer conductor may be formed by covering the ceramic dielectric insulator blocks with a heated and thermally expanded metal pipe of copper, silver or aluminum whose inner diameter is slightly smaller than the outer diameter of the ceramic dielectric blocks at room temperature. Electroless plating method is also applicable to form the outer conductor.

In the above description of the embodiment of the present invention, a band pass filter is place at each end of the main delay line portion 70. However, in modification, a band pass filter for the purposes of adjusting the overall frequency transfer characteristic and impedance matching may be placed at one end of the main delay line portion, and a λ/4 transformer portion for the purpose of impedance matching may be placed at the other end. If a target frequency transfer characteristic curve is obtained by such configuration of a band pass filter and a λ/4 transformer portion, it is much better from smaller insertion loss point of view. The used band pass filters may be different type such as cavity or helical type band pass filter other than dielectric resonator type, and the number of stages is not limited to two.

Figure 10:
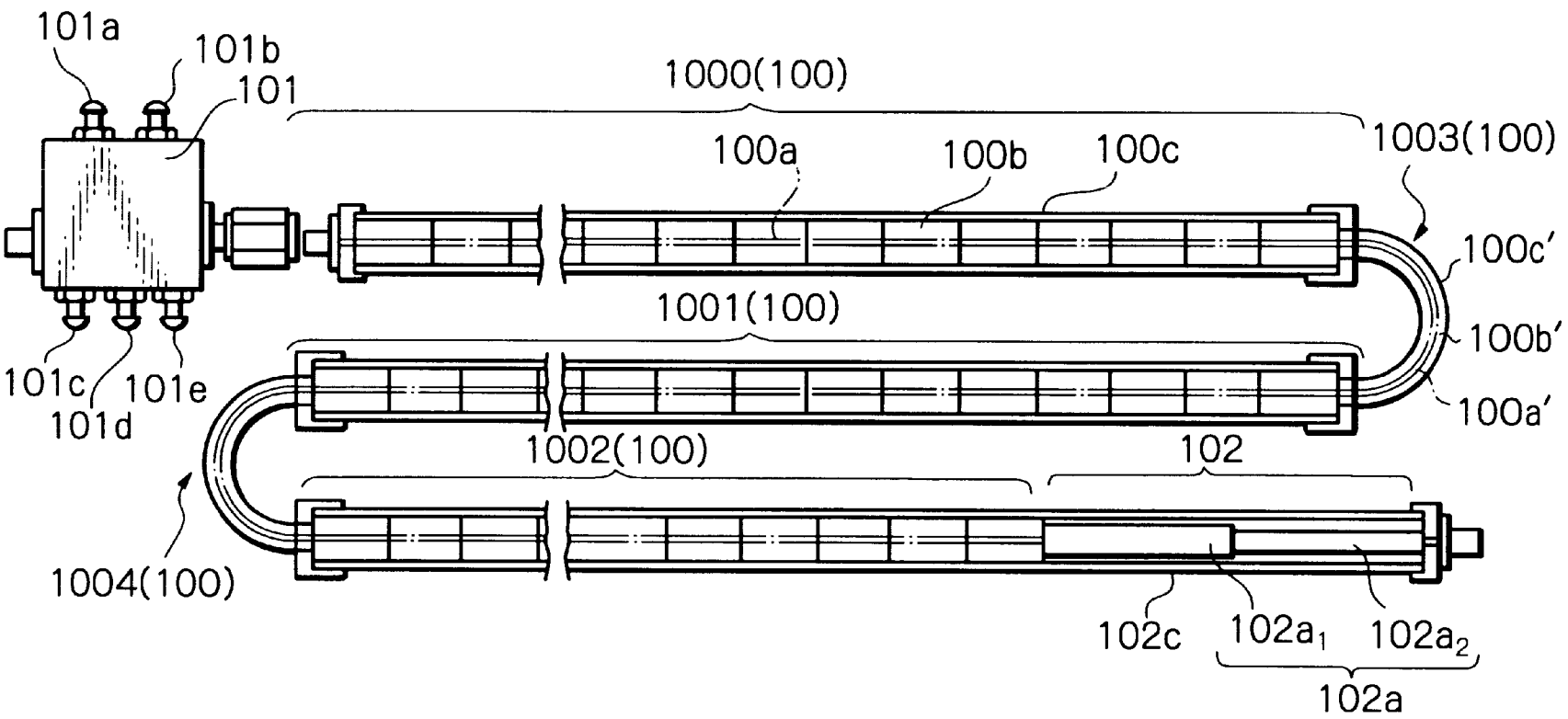
FIG. 10 is a view schematically illustrating a structure of a delay compensation device with a coaxial cable type delay line component of still further embodiment according to the present invention.

FIG. 10 schematically illustrates a structure of a delay compensation device with a coaxial cable type delay line component of still further embodiment according to the present invention.

In the figure, reference number 100 is a main delay line portion of the delay compensation device, 101 is a band pass filter placed at one end of the main delay line portion 100, and 102 is a λ/4 transformer portion placed at the other end of the main delay line portion.

The main delay line portion 100 is almost similar with the main delay line portion 60 of the embodiment of the present invention shown in FIG. 6. The main delay line portion 100 is folded up to get larger delay time by smaller form factor, and consequently it consists of three straight coaxial cable lines 1000, 1001 and 1002, and two curved coaxial cable lines 1003 and 1004 for serially connecting the straight coaxial cable lines 1000, 1001 and 1002.

Each of the straight coaxial cable lines 1000,1001 and 1002 of the main delay line portion 100 consists of a center conductor 10*a*, a ceramic dielectric 100*b* which surrounds the center conductor 10*a*, and an outer conductor 100*c* which is formed on the outer surface of the ceramic dielectric 100*b*.

Each of the curved coaxial cable lines 1003 and 1004 of the main delay line portion 100 consists of a center conductor 100*a*', a dielectric 100*b*' which surrounds the center conductor 100*a*', and an outer conductor 100*c*' which is formed on the outer surface of the dielectric 100*b*'.

The λ/4 transformer portion 102 has a center conductor 102*a* and an outer conductor 102*c* which surrounds the center conductor with air gap.

The ceramic dielectric 100*b* of the straight coaxial cable lines 1000, 1001 and 1002 of the main delay line portion 100 is formed by linking, along the direction of the coaxial axis, twenty block pieces of cylindrical shaped or polygonal tube shaped and sintered ceramic blocks of post molded and sintered dimensions, the outer diameter of 6 mm, the length along the axis of 15 mm, and the center hole diameter of 1.0 mm. Each of the blocks is made by sintering of press molded ceramic materials which has large dielectric constant value $\in r=92$ and high quality factor $Q \geqq 7000$.

In a modification, a resin including ceramic particles of large dielectric constant may be used as the dielectric material of the coaxial cable line, although there are some application limitations of its dielectric constant and manufacturing process.

An elastic resin type dielectric insulator, which includes ceramic particles of large dielectric constant $\in r=10$ is used for the dielectric insulator 100*b*' of the curved coaxial cable lines 1003 and 1004 other than rigid sintered ceramic because of the necessity of keeping resistivity against mechanical vibration and impact shock. A metal pipe such as copper, silver or aluminum pipe is used as the outer conductor 100*c*'. The curved coaxial cable lines 1003 and 1004 are formed so that the characteristic impedance thereof becomes 11.2 Ω.

In this embodiment of the present invention in FIG. 10, there is no dielectric material in the λ/4 transformer portion 102 but there is air between the center and outer conductors.

The center conductors 100*a* of the main delay line portion 100 are formed by rolled thin (thickness of 100 μm) metal (annealed copper, silver, silver plated aluminum) pipe, which is inserted into the center hole of the ceramic dielectric 100*b* of cylindrical shaped or polygonal tube shaped ceramic blocks. The metal pipe is expanded by static inside pressure by press or explosive gaseous pressure by gunpowder and firmly attached or fixed to the inside surfaces of the center holes of the dielectric blocks. This process can minimize the resistance of the center conductor made from silver paste because of non-grain boundary.

The center conductor 102*a* of the λ/4 transformer portion 102 is made of two different diameter solid metal cylinders, 102*a*, and 102$a_2$.

The outer conductor 100*c* of the straight coaxial cable lines 1000, 1001 and 1002 of the main delay line portion 100 is formed by covering the ceramic dielectric blocks with a heated and thermally expanded metal pipe of copper, silver or aluminum whose inner diameter is slightly smaller than the outer diameter of the ceramic dielectric insulator at room temperature. The dimensions of the metal pipe and the heating temperature are to be defined reflecting the operating temperature under actual application conditions. The outer conductor 102*c* of the λ/4 transformer portion 102 is formed by extension of the metal pipe.

Similarly with the band pass filter in FIG. 7, the band pass filter 101 consists of capacity coupled two staged resonators of ceramic dielectrics. By adjusting screws 101*a*–101*e*, capacitance values of the filter can be changed, and consequently the frequency transfer characteristics can be controlled.

A typical radio frequency power amplifier has a frequency transfer characteristic of single-humped or double-humped resonance curve. The band pass filter 101 is adjusted to get maximally flat type or Chebyshev type curve, and thus the overall frequency transfer characteristic of the radio frequency power amplifier with the delay compensation device which includes these band pass filter can be compensated. By adjusting the frequency transfer characteristic curve of the band pass filter 101 or by selecting a filter for a proper transfer characteristic, the overall frequency transfer characteristic of the radio frequency power amplifier can be easily adjusted to a desired curve.

The use of larger dielectric constant ($\in r=37$, quality factor $Q \geqq 10000$) ceramic material as the ceramic dielectric insulator 100*b* of the main delay line portion 100 gives lower characteristic impedance $Z_0$ which is usually difficult for direct connection with another device as in the previously described embodiment of the present invention. Typical characteristic impedance of widely used radio frequency equipments is 50 Ω. On the other hand, the characteristic impedance of the delay line component according to the present invention is very low and down to 11.2 Ω, because dielectric materials of large dielectric constant and center conductors of large diameter for small insertion loss are used. Impedance matching is needed in actual applications of this kind of delay line component. For that purpose of impedance matching, the band pass filter 101 in addition to adjusting the overall frequency transfer characteristic is place at one end of the main delay line portion 100, and the λ/4 transformer portion 102 is placed at the other end.

In this embodiment of the present invention in FIG. 10, the λ/4 transformer portion 102 has two different diameter solid metal cylinders whose electrical lengths along the axis are chosen to be equivalent to λ/4 at operating frequency.

In this embodiment, the ceramic dielectric insulator 100*b* of the straight coaxial cable lines 1000, 1001 and 1002 of main delay line portion 100 is formed by linking, along the direction of the coaxial axis, twenty block pieces of cylindrical shaped or polygonal tube shaped and sintered ceramic blocks. Using of these three the straight coaxial lines which are serially connected provides about 30 nanoseconds of delay time.

In this embodiment of the present invention shown in FIG. 10, the center conductor is formed by rolled thin (thickness of 100 μm) metal (annealed copper, silver, silver plated aluminum) pipe, which is inserted into the center holes of the ceramic dielectric blocks and is expanded by static inside pressure by press or explosive gaseous pressure by gunpowder and firmly attached or fixed to the inside surfaces of the center holes of the ceramic dielectric blocks. In modification, this center conductor may be formed by melting sintered silver, copper or another metal paste filled inside the center holes of the ceramic dielectric blocks as the embodiment of the present invention shown in FIG. 2. In further modification, the center conductor may be formed by insertion of a solid metal wire such as copper, silver or aluminum wire into the center holes of the ceramic dielectric blocks. And also pulse-plating method may be applied to form a center conductor on the inside surfaces of the center holes of the ceramic dielectric blocks.

In this embodiment of the present invention shown in FIG. 10, covering the ceramic dielectric blocks with a heated and thermally expanded metal pipe forms the coaxial outer conductor. In modification, the outer conductors may be formed by sintering of silver paste on the surfaces of the ceramic dielectric blocks. Electroless plating method is also applicable to form the outer conductor.

In the above description of the embodiment of the present invention, only one band pass filter is placed at one end of the main delay line portion 100, and a target frequency transfer characteristic curve is obtained by such configuration of a band pass filter and a λ/4 transformer portion. This is much better from smaller insertion loss point of view. Of course, two band pass filters can be place at the both ends. The used band pass filters may be different types such as cavity type or helical type other than dielectric resonator type, and the number of stages is not limited to two.

A few embodiment of the present invention have been described in detail, but it is particularly understood that invention is not limited thereof and thereby. There may be many different physical placements of components referred in the present invention reflecting actual physical requirements. Connecting directional couplers at ends of a transmission line is very effective from FF featured power amplifier design point of view. Impedance matching can be done at different impedance values other than 50 Ω.

Many widely different embodiments of the present invention may be constructed without departing from the spirit and scope of the present invention. It should be understood that the present invention is not limited to the specific embodiments described in the specification, except as defined in the appended claims.

As described above, the delay line component is consists of ceramic dielectric of large dielectric constant, and consequently the length of such line can be short, the physical size becomes small, and small insertion loss can be obtained due to short length of the line. Thanks for applying dielectric materials of large quality factor Q, the insertion loss can be greatly reduced. Also, since the delay line component by the present invention is built as coaxial structure, the frequency transfer characteristic is very flat and stable.

Furthermore, because adjustments of impedance matching and frequency transfer characteristics are done by inserted adjustable band pass filters, the overall frequency transfer characteristics are easily adjusted to the target after assembling a radio frequency power amplifier system by the delay compensation device and also volume production of such FF featured power amplifier systems of very small IMD components is possible.

What is claimed is:

1. A coaxial cable type delay line component including a line portion provided with a center conductor, a ceramic dielectric which surrounds the center conductor, and an outer conductor which is formed outside the ceramic dielectric, said ceramic dielectric being made of sintered ceramic dielectric material with a large dielectric constant, and at least said center conductor being made of a metal conductor with no grain boundary.

2. The delay line component as claimed in claim 1, wherein a part of said delay line component consists of another line portion provided with a center conductor, a dielectric which surrounds the center conductor, and an outer conductor which is formed outside the dielectric, and wherein said dielectric is made of a dielectric with a resin in which ceramic particles are mixed.

3. The delay line component as claimed in claim 1, wherein said center conductor is formed by a metal conductor melted and sintered in a center hole of said ceramic dielectric.

4. The delay line component as claimed in claim 1, wherein said center conductor is formed by a pipe-shaped metal conductor inserted and rolled in a center hole of said ceramic dielectric.

5. The delay line component as claimed in claim 4, wherein said center conductor is formed by a metal conductor which is expanded by static inside pressure or by explosive gaseous pressure caused by gunpowder and closely contacted to an inner surface of said center hole.

6. The delay line component as claimed in claim 1, wherein said center conductor is formed by a wire-shaped solid metal conductor inserted into a center hole of said ceramic dielectric.

7. The delay line component as claimed in claim 1, wherein said ceramic dielectric is formed by linking, along an axis of said delay line component, a plurality of independent ceramic dielectric blocks each having a predetermined axis length.

8. The delay line component as claimed in claim 7, wherein each of said ceramic dielectric blocks is formed by a cylindrical shaped or polygonal tube shaped block with a center hole.

9. The delay line component as claimed in claim 1, wherein said outer conductor is formed by a metal film sintered on an outer surface of said ceramic dielectric.

10. The delay line component as claimed in claim 1, wherein said outer conductor is formed by a pipe-shaped metal conductor which covers in contact an outer surface of said ceramic dielectric.

11. The delay line component as claimed in claim 1, wherein the ceramic dielectric located in at least one end portion of said delay line component has a dielectric constant which is different from that of the ceramic dielectric located in another portion of said delay line component.

12. The delay line component as claimed in claim 1, wherein the ceramic dielectric located in at least one end portion of said delay line component has a ratio of inner/outer diameters which is different from that of the ceramic dielectric located in another portion of said delay line component.

13. The delay line component as claimed in claim 1, wherein the center conductor located in at least one end portion of said delay line component has an outer diameter which is different from that of the center conductor located in another portion of said delay line component.

14. The delay line component as claimed in claim 1, wherein said delay line component consists of only a straight coaxial cable line portion.

15. The delay line component as claimed in claim 1, wherein said delay line component includes a plurality of straight coaxial cable line portions, and a plurality of curved coaxial cable line portions which connect said straight coaxial cable line portions with each other.

16. The delay line component as claimed in claim 15, wherein each of said curved coaxial cable line portions is formed by a line portion provided with a center conductor, a dielectric which surrounds the center conductor, and an outer conductor which is formed outside the dielectric, and wherein said dielectric of each curved coaxial cable line portion is made of a dielectric with ceramic particles mixed in a soft resin.

17. The delay line component as claimed in claim 15, wherein each of said curved coaxial cable line portions is formed by a line portion provided with a center conductor, a ceramic dielectric which surrounds the center conductor, and an outer conductor which is formed outside the ceramic dielectric, and wherein said ceramic dielectric of each curved coaxial cable line portion is made of a plurality of independent ceramic dielectric blocks.

18. A delay compensation device comprising a delay line component including a line portion provided with a center conductor, a ceramic dielectric which surrounds the center conductor, and an outer conductor which is formed outside the ceramic dielectric, said ceramic dielectric being made of sintered ceramic dielectric material with a large dielectric constant, and at least said center conductor being made of a metal conductor with no grain boundary, and a band pass filter connected with at least one end of said delay line component.

19. The delay compensation device as claimed in claim 18, wherein said band pass filter is designed so that its frequency transfer characteristics is adjustable.

20. The delay compensation device as claimed in claim 19, wherein an input characteristic impedance and an output characteristic impedance are different with each other in said band pass filter.

21. The delay compensation device as claimed in claim 18, wherein a band pass filter is connected with only one end of said delay line component.

22. The delay compensation device as claimed in claim 18, wherein band pass filters are connected with the both ends of said delay line component, respectively.

23. The delay compensation device as claimed in claim 18, wherein said delay line component consists of only a straight coaxial cable line portion.

24. The delay compensation device as claimed in claim 18, wherein said delay line component includes a plurality of straight coaxial cable line portions, and a plurality of curved coaxial cable line portions which connect said straight coaxial cable line portions with each other.

25. A method of manufacturing a coaxial cable type delay line component which includes a line portion provided with a center conductor, a ceramic dielectric which surrounds the center conductor, and an outer conductor which is formed outside the ceramic dielectric, said method comprising a step of forming said ceramic dielectric by sintering ceramic dielectric materials with a large dielectric constant, at least said center conductor being made of a metal conductor with no grain boundary.

26. The method as claimed in claim 25, wherein a part of said delay line component consists of another line portion provided with a center conductor, a dielectric which surrounds the center conductor, and an outer conductor which is formed outside the dielectric, and wherein said method comprising a step of forming said dielectric by mixing ceramic particles in a resin.

27. The method as claimed in claim 25, wherein said center conductor is formed by filling metal material into a center hole of said ceramic dielectric, and by melting and sintering the filled metal material.

28. The method as claimed in claim 25, wherein said center conductor is formed by inserting a pipe-shaped metal conductor into a center hole of said ceramic dielectric, and by expanding said pipe-shaped metal conductor by static inside pressure or explosive gaseous pressure caused by gunpowder to closely contact to an inside surface of said center hole.

29. The method as claimed in claim 25, wherein said center conductor is formed by inserting a wire-shaped solid metal conductor into a center hole of said ceramic dielectric.

30. The method as claimed in claim 25, wherein said ceramic dielectric is formed by making a plurality of independent ceramic dielectric blocks each having a predetermined axis length, and by linking, along an axis of said delay line component, the plurality of the ceramic dielectric blocks.

31. The method as claimed in claim 25, wherein said outer conductor is formed by covering an outer surface of said ceramic dielectric with a metal paste and by sintering the metal paste.

32. The method as claimed in claim 25, wherein said outer conductor is formed by covering an outer surface of said ceramic dielectric with a pipe-shaped metal conductor.

* * * * *

UNITED STATES PATENT AND TRADEMARK OFFICE

CERTIFICATE OF CORRECTION

PATENT NO. : 6,337,609 B1
DATED : January 8, 2002
INVENTOR(S) : Kenji Endou et al.

It is certified that error appears in the above-identified patent and that said Letters Patent is hereby corrected as shown below:

Title page,
Please change the following information:
"[22] PCT Filed: [July 14, 1997]" should read:
[22] PCT Filed: -- July 14, 1998 --.

Signed and Sealed this

Thirtieth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,337,609 B1
DATED : January 8, 2002
INVENTOR(S) : Kenji Endou et al.

It is certified that error appears in the above-identified patent and that said Letters Patent is hereby corrected as shown below:

Title page,
Change Item [22] PCT Filed: "July 14, 1997" to [22] PCT Filed: -- July 14, 1998 --.

Signed and Sealed this

Nineteenth Day of August, 2003

JAMES E. ROGAN
*Director of the United States Patent and Trademark Office*